US011613408B2

(12) United States Patent
Sushkov

(10) Patent No.: US 11,613,408 B2
(45) Date of Patent: Mar. 28, 2023

(54) STORAGE AND DISPENSER FOR HERBS JOINED WITH ROLLING PAPER STORAGE AND DISPENSER

(71) Applicant: Ruslan Sushkov, Brooklyn, NY (US)

(72) Inventor: Ruslan Sushkov, Brooklyn, NY (US)

( * ) Notice: Subject to any disclaimer, the term of this patent is extended or adjusted under 35 U.S.C. 154(b) by 10 days.

(21) Appl. No.: 16/988,676

(22) Filed: Aug. 9, 2020

(65) Prior Publication Data

US 2021/0245923 A1 Aug. 12, 2021

Related U.S. Application Data

(60) Provisional application No. 62/905,872, filed on Sep. 25, 2019.

(51) Int. Cl.

| | |
|---|---|
| ***B65D 25/04*** | (2006.01) |
| ***B65D 83/08*** | (2006.01) |
| ***B65D 83/06*** | (2006.01) |

(52) U.S. Cl.

CPC ..... *B65D 25/04* (2013.01); *B65D 83/06* (2013.01); *B65D 83/0805* (2013.01); *B65D 2583/082* (2013.01)

(58) Field of Classification Search

CPC .... B65D 25/04; B65D 83/06; B65D 83/0805; B65D 2583/082

USPC ..... 220/523; 206/242–276, 38, 237

See application file for complete search history.

(56) References Cited

U.S. PATENT DOCUMENTS

| | | | | | |
|---|---|---|---|---|---|
| 906,644 | A * | 12/1908 | Meade | A24F 23/04 | 220/826 |
| 918,928 | A * | 4/1909 | Thomas | A24F 19/10 | 206/136 |
| 919,659 | A * | 4/1909 | Webber | A24F 23/04 | 206/237 |
| 1,045,366 | A * | 11/1912 | Bjelland | A24F 23/04 | 206/237 |
| 1,124,257 | A * | 1/1915 | Bartels | B65D 85/1036 | 206/266 |
| 1,193,427 | A * | 8/1916 | Rose | A24F 23/04 | 206/237 |
| 1,221,896 | A * | 4/1917 | Page | A24F 23/04 | 206/267 |
| 1,279,946 | A * | 9/1918 | Tompkins | A24F 23/04 | 206/237 |
| 1,413,391 | A * | 4/1922 | Clark | A24F 23/04 | 206/237 |
| 1,489,993 | A * | 4/1924 | Etheridge | A24F 23/04 | 206/265 |
| 1,506,926 | A * | 9/1924 | Gunter | A24F 23/04 | 383/106 |

(Continued)

FOREIGN PATENT DOCUMENTS

ES 1228327 4/2019

*Primary Examiner* — Chun Hoi Cheung

(74) *Attorney, Agent, or Firm* — Michael J. Feigin, Esq.; Feigin and Fridman LLC

(57) ABSTRACT

An article of manufacture providing a storage and dispenser for herbs joined with a rolling paper storage and dispenser is disclosed. The present invention described herein joins all of the necessary parts into one single unit. The invention provides a storage for dry herbs, a dispenser, a box of rolling papers, and paper tips/filters all in one unit. The storage of dry herbs is integral to all of the other components into one discrete unit.

3 Claims, 12 Drawing Sheets

(56) References Cited

U.S. PATENT DOCUMENTS

| | | | | | |
|---|---|---|---|---|---|
| 1,664,160 | A * | 3/1928 | Clement | A24F 23/04 | 206/237 |
| 1,996,749 | A * | 4/1935 | Crosley | A24F 17/00 | 206/237 |
| 2,011,399 | A * | 8/1935 | Driscoll | B65D 85/1081 | 206/237 |
| 2,047,090 | A * | 7/1936 | Woolfson | B65D 81/22 | 221/95 |
| 2,202,322 | A * | 5/1940 | Scull | A24F 17/00 | 221/48 |
| 2,281,663 | A * | 5/1942 | Bohr | A24F 17/00 | 220/827 |
| 2,488,411 | A * | 11/1949 | Kent | A24F 23/04 | 206/237 |
| 2,831,571 | A * | 4/1958 | Erbel | B65D 75/54 | 206/237 |
| 3,006,348 | A * | 10/1961 | Banning, Jr. | A24C 5/44 | 206/237 |
| 5,785,221 | A * | 7/1998 | Bishop | G09F 3/0352 | 24/3.13 |
| 5,927,488 | A * | 7/1999 | Gray | A24F 23/04 | 206/256 |
| 5,967,310 | A * | 10/1999 | Hill | A24F 23/04 | 206/242 |
| 9,635,884 | B2 | 5/2017 | Shalom | | |
| 2008/0142379 | A1* | 6/2008 | Gnatenko | A45C 11/00 | 206/38 |
| 2011/0266164 | A1* | 11/2011 | Santoro | B65D 67/02 | 220/500 |
| 2018/0332892 | A1 | 11/2018 | Beaver | | |

* cited by examiner

STORAGE AND DISPENSER FOR HERBS JOINED WITH ROLLING PAPER STORAGE AND DISPENSER

CROSS-REFERENCE TO RELATED APPLICATIONS

This application claims priority to U.S. Provisional Patent Application No. 62/905,872, titled "STORAGE AND DISPENSER FOR HERBS JOINED WITH ROLLING PAPER STORAGE AND DISPENSER," and filed on Sep. 25, 2019. The entire application is incorporated herein by reference in its entirety.

TECHNICAL FIELD

This application relates in general to an article of manufacture for providing a personal storage device, and more specifically, to an article of manufacture for an herb storage and dispenser joined with a rolling paper storage and dispenser.

BACKGROUND

Carrying dry herbs and rolling papers separately is both uncomfortable and messy. Separation of the two often leads to one of the items missing. Currently there are no dry herb containers which are equipped with rolling papers built into the unit.

Therefore, a need exists for an article of manufacture for an herb storage and dispenser joined with a rolling paper storage and dispenser. The invention described herein joins all of the necessary parts into a single unit. The invention provides storage for dry herbs, a dispenser, a box of rolling papers, and paper tips/filters all-in-one. The storage of dry herbs is integral to all of the other components in this discrete double dispenser.

SUMMARY

In accordance with the present invention, the above and other problems are solved by providing an article of manufacture for a storage and dispenser for herbs joined with rolling paper storage and dispenser according to the principles and example embodiments disclosed herein.

In one embodiment, the present invention is an article of manufacture providing a storage and dispenser for herbs joined with a rolling paper storage and dispenser. The invention provides a storage for dry herbs, a dispenser, a box of rolling papers, and paper tips/filters all in one unit. The storage of dry herbs is integral to all of the other components in this discrete unit.

The foregoing has outlined rather broadly the features and technical advantages of the present invention in order that the detailed description of the invention that follows may be better understood. Additional features and advantages of the invention will be described hereinafter that form the subject of the claims of the invention.

It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only, and is not intended as a definition of the limits of the present invention.

BRIEF DESCRIPTION OF THE DRAWINGS

Referring now to the drawings in which like reference numbers represent corresponding parts throughout.

DETAILED DESCRIPTION

Figure 1:
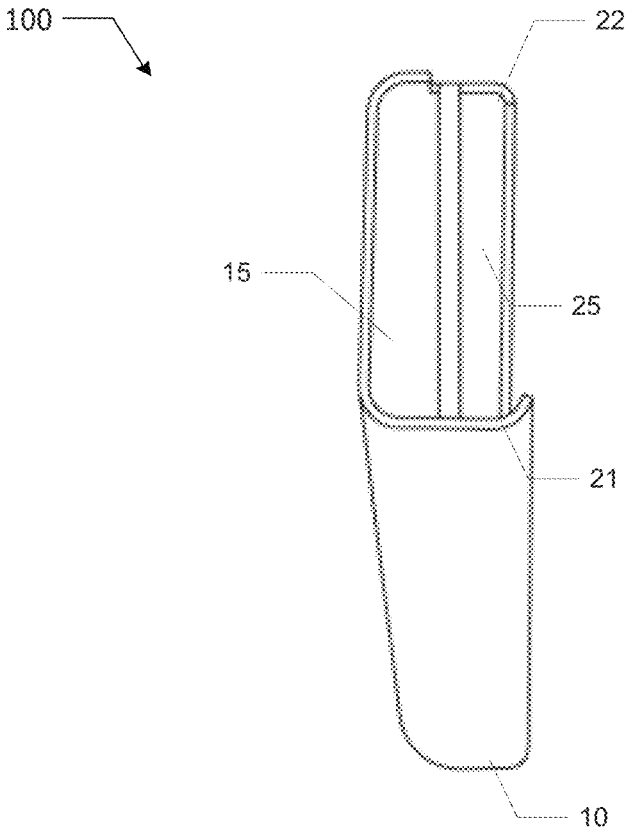
FIG. 1 illustrates an example embodiment of an article of manufacture for an herb storage and dispenser joined with a rolling paper storage and dispenser according to the present invention.

This application relates in general to an article of manufacture for providing a personal storage device, and more specifically, to an article of manufacture for an herb storage and dispenser joined with a rolling paper storage and dispenser according to the present invention.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In describing embodiments of the present invention, the following terminology will be used. The singular forms "a,' an," and "the" include plural referents unless the context clearly dictates otherwise. Thus, for example, reference to "a needle" includes reference to one or more of such needles and "etching" includes one or more of such steps. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As used herein, the singular forms "a," "an," and "the" are intended to include the plural forms as well, unless the context clearly indicates otherwise.

It further will be understood that the terms "comprises,' comprising," "includes," and "including" specify the presence of stated features, steps or components, but do not preclude the presence or addition of one or more other features, steps or components. It also should be noted that in some alternative implementations, the functions and acts noted may occur out of the order noted in the figures. For example, two figures shown in succession may in fact be executed substantially concurrently or may sometimes be executed in the reverse order, depending upon the functionality and acts involved.

As used herein, the term "about" means that dimensions, sizes, formulations, parameters, shapes, and other quantities and characteristics are not and need not be exact, but may be approximated and/or larger or smaller, as desired, reflecting tolerances, conversion factors, rounding off, measurement error and the like, and other factors known to those of skill. Further, unless otherwise stated, the term "about" shall expressly include "exactly."

The terms "customer," and "user" refer to an entity, e.g. a human, using the article of manufacture for a storage and dispenser for herbs joined with a rolling paper storage and dispenser associated with the invention. The term user herein refers to one or more users.

The term "invention" or "present invention" refers to the invention being applied for via the patent application with the title "A STORAGE AND DISPENSER FOR HERBS JOINED WITH ROLLING PAPER STORAGE AND DISPENSER." Invention may be used interchangeably with storage container or unit.

Figure 2:
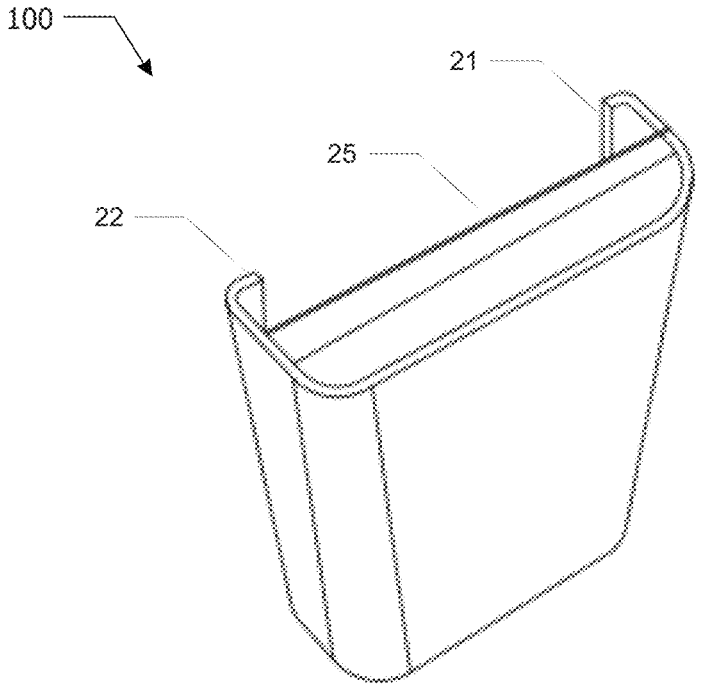
FIG. 2 illustrates a top rear view of an article of manufacture for a storage and dispenser for herbs joined with a rolling paper storage and dispenser according to the present invention.
Figure 3:
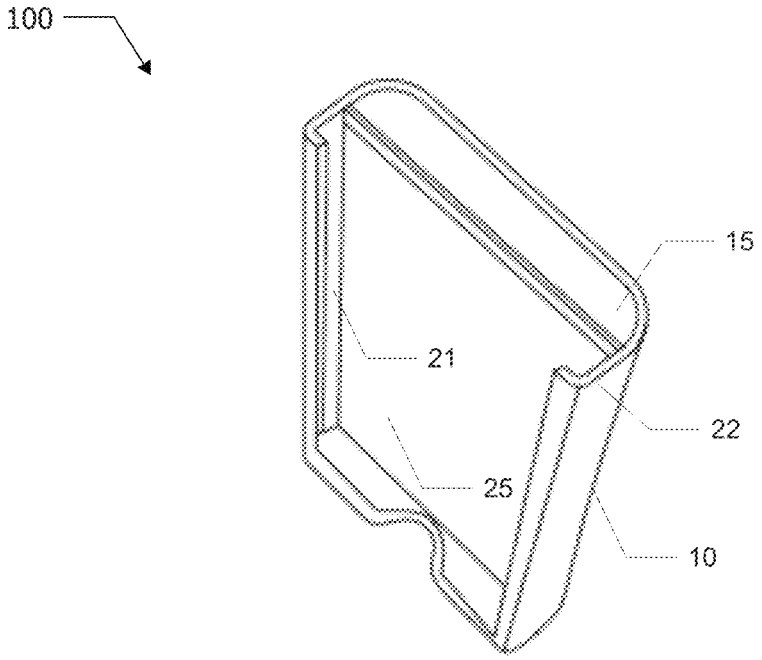
FIG. 3 illustrates a top front view of an article of manufacture providing a storage and dispenser for herbs joined with a rolling paper storage and dispenser according to the present invention.

In general, the present disclosure relates to an article of manufacture for providing a personal storage device. To better understand the present invention, FIG. 1 illustrates an example embodiment for article of manufacture providing a storage and dispenser for herbs joined with a rolling paper storage and dispenser according to the present invention. FIG. 2 illustrates a top rear view of the article of manufacture providing a storage and dispenser for herbs joined with a rolling paper storage and dispenser according to the present invention. FIG. 3 illustrates a top front view of the article of manufacture providing a storage and dispenser for herbs joined with a rolling paper storage and dispenser according to the present invention.

The present invention 100 is made in a manufacturing factory which produces plastic/glass containers as well as a manufacturer/factory which produces rolling papers. The necessary elements are a container 10 with a removable lid 20 as well as a smaller dispensing lid 24 that opens to provide dispensing action of the contents. Rolling papers 30 are a necessary portion of the invention. A pair of retaining rails 21-22 on the outer sides of the container 10 serve as an integrated rolling paper cartridge 25 into which the pack of rolling papers 30 is inserted to be carried as one piece with the container 10.

The pair of retaining rails 21-22 is optional and may be substituted with gluing of the rolling paper tray onto the container. The pair of retaining rails 21-22 is preferred in order to make the container reusable. The container 10 may be made out of glass and metal, providing the same function as that which is made out of plastic. The components can be made in various sizes/dimensions to accommodate different storage volume as well as to accommodate different-sized rolling papers.

Figure 4:
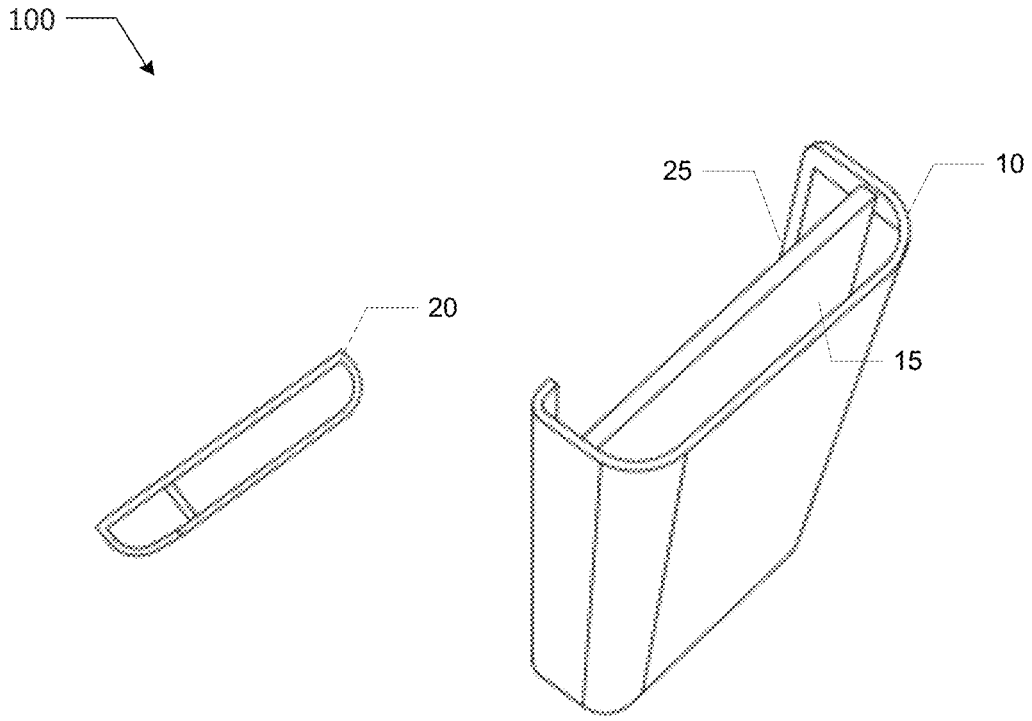
FIG. 4 illustrates a top rear view and removable lid of an article of manufacture for a storage and dispenser for herbs joined with a rolling paper storage and dispenser according to the present invention.
Figure 5:
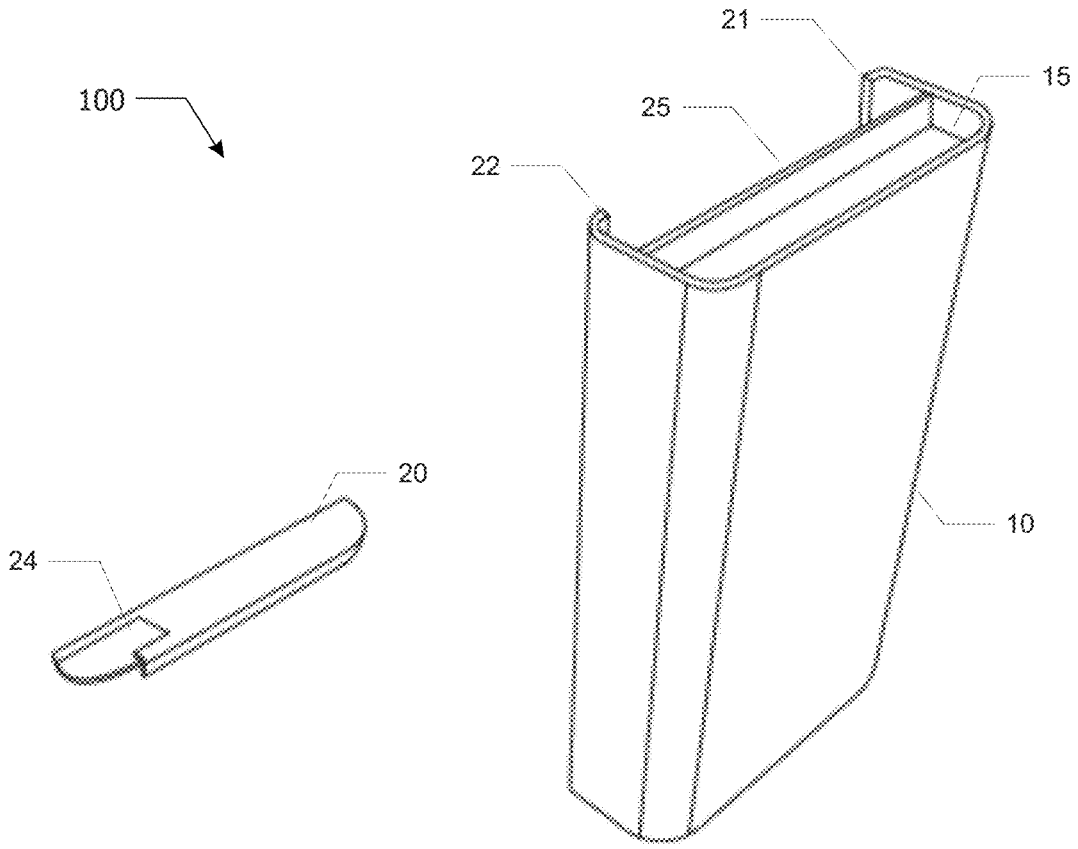
FIG. 5 illustrates a side rear view with smaller lid of an article of manufacture providing a storage and dispenser for herbs joined with a rolling paper storage and dispenser according to the present invention.
Figure 6:
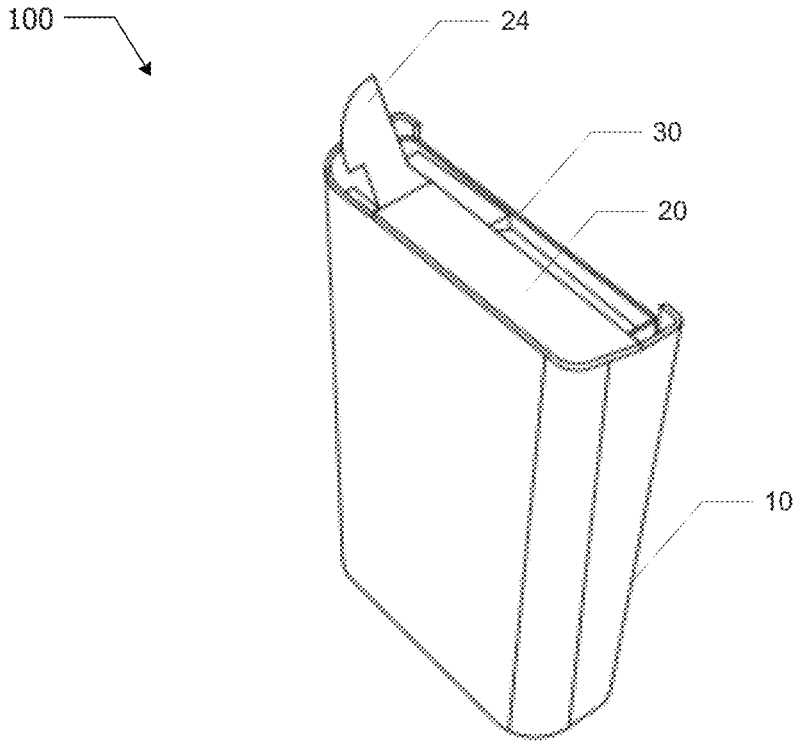
FIG. 6 illustrates a top rear view with removable lid of an article of manufacture for a storage and dispenser for herbs joined with a rolling paper storage and dispenser according to the present invention.

FIG. 4 illustrates a top rear view of the article of manufacture providing a storage and dispenser 10 for herbs joined with a rolling paper storage and dispenser along with the removable lid 20 according to the present invention. FIG. 5 illustrates another side rear view of the article of manufacture for a storage and dispenser 10 for herbs joined with a rolling paper storage and dispenser along with the removable lid 20 having a smaller dispensing lid 24 according to the present invention. FIG. 6 illustrates an example embodiment of a top rear view of the article of manufacture for a storage and dispenser 10 for herbs joined with a rolling paper storage and dispenser having the removable lid 20 installed with an open smaller dispensing lid 24 open according to the present invention.

The dry herb container 10 with a removable and openable lid 20 is joined with rolling papers 30 into one unit. The container has a pair of retaining rails 21-22 on the sides to fit the dimensions of a standard rolling paper pack 30. On the horizontal bottom portion of the rails/container there is a protruding flat surface to keep the rolling papers box in place, attached to the container 10. The result is a dry herb dispenser box with rolling papers attached to it.

The lid 20 of the container is fully removable in order to easily fill the storage compartment 15 with dry herbs. The lid 20 is equipped with a smaller attached lid portion 24 which enables the dispensing of the contents in a measured and controlled way onto the rolling paper 30. Once a user finishes dispensing, closing the lid 24 will ensure that the contents of the storage compartment 15 are stored safely without the risk of falling out.

The herb container has a pair of retaining rails 21-22 attached to it which enables the appropriately-sized rolling papers 30 to be inserted and stored on the outer side of the container 10. When the rolling papers 30 are used up and the rolling paper tray is empty, it is removed and replaced with a new set of rolling papers. The container is refillable and reusable.

Figure 7:
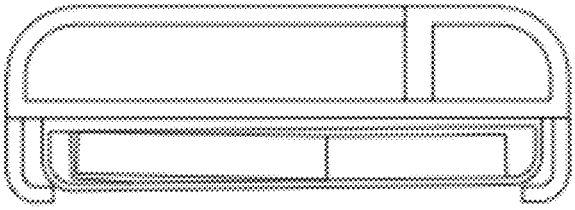
FIG. 7 illustrates a top view with rolling papers of an article of manufacture for an herb storage and dispenser joined with a rolling paper storage and dispenser according to the present invention.
Figure 8:
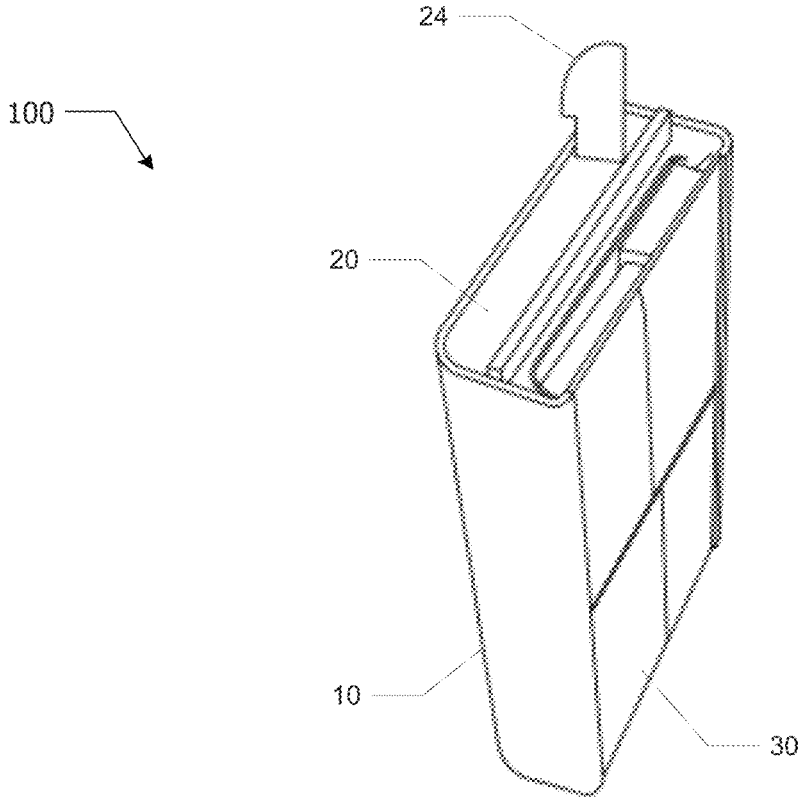
FIG. 8 illustrates a top side view with rolling papers of an article of manufacture for a storage and dispenser for herbs joined with a rolling paper storage and dispenser according to the present invention.
Figure 9:
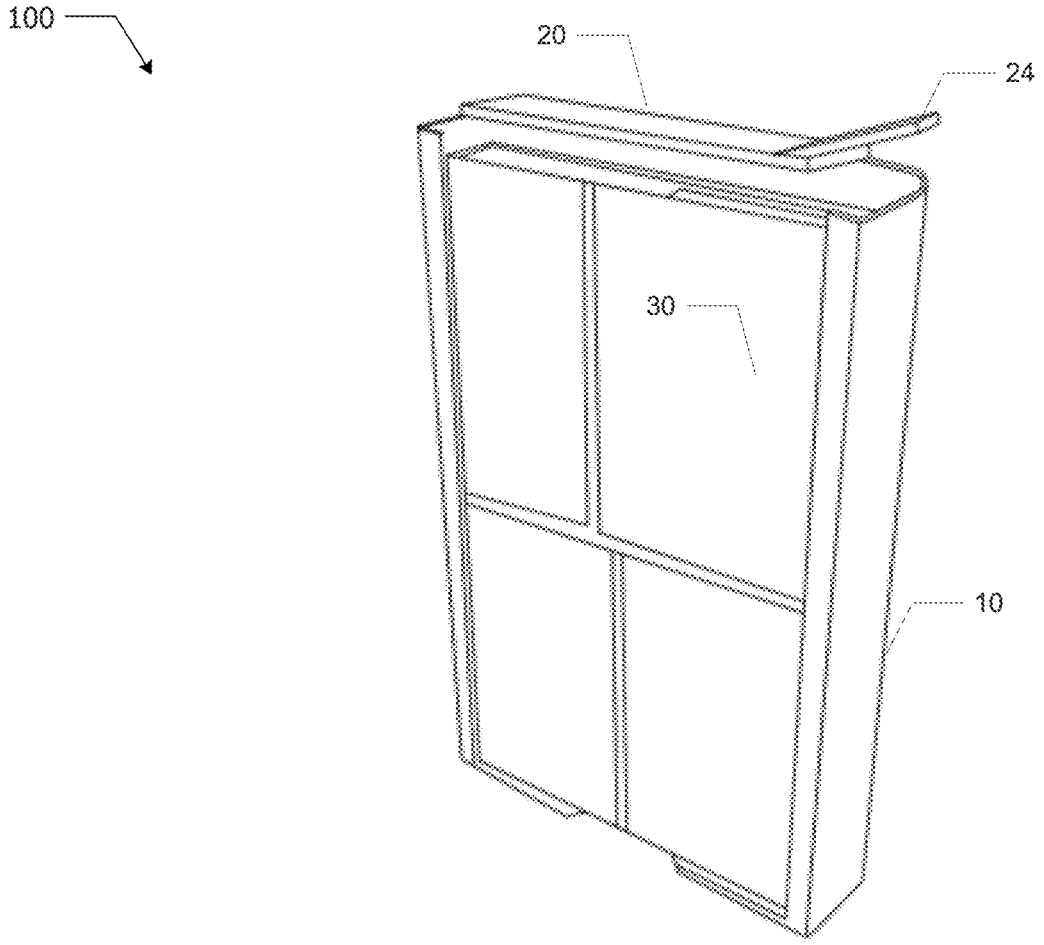
FIG. 9 illustrates a front top view with rolling papers of an article of manufacture providing an herb storage and dispenser joined with a rolling paper storage and dispenser according to the present invention.

FIG. 7 illustrates a top view of an article of manufacture for a storage and dispenser 10 for herbs joined with a rolling paper pack 30 installed within the storage cartridge 25 according to the present invention. FIG. 8 illustrates a top side view of an article of manufacture for the storage and dispenser 10 for herbs joined with a rolling paper pack 30 installed within an integrated rolling paper cartridge 25 according to the present invention. Similarly, FIG. 9 illustrates a front top view of an article of manufacture for a storage and dispenser 10 for herbs joined with a rolling paper pack 30 installed within the integrated rolling paper cartridge 25 and the removable lid 20 in place with its smaller dispensing lid 24 according to the present invention.

By the design of the invention, the user of the invention will be able to have all the necessary items to roll a dry herb blend into a paper. The container 10 is equipped with the rolling papers 30 and dispensing lid 24 to dispense the contents of the storage compartment 15 onto the rolling paper 30 which the user has pulled out of the integrated rolling paper cartridge 25 which is attached to the side of the container 10. After finishing the process, the container 10 is easily stored in a pocket or any desired place of storage, keeping all of the required parts together.

Additionally, the contents of the container are up to a user's discretion. The storage compartment 15 and an integrated rolling paper cartridge 25 are a single unit 10 with an option to have filter tips stored within/on the same unit. An additional lighting unit (such as a custom lighter or matches) may be installed onto the side of the unit 10 to provide every necessary element for the process involved.

Figure 10:
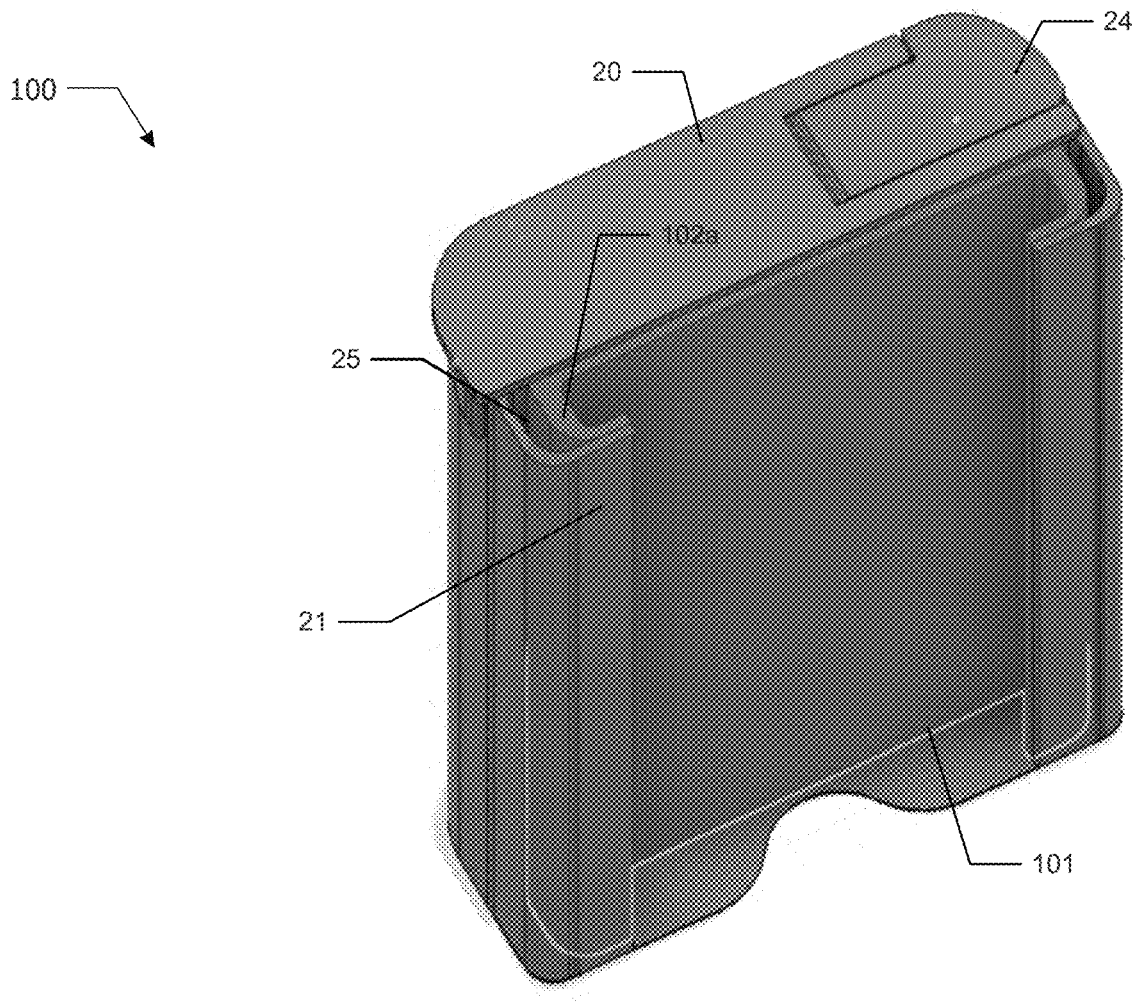
FIG. 10 illustrates a front top view of an article of manufacture providing an herb storage and dispenser joined with a rolling paper storage and dispenser having a removable nest holding smaller rolling papers according to the present invention.

FIG. 10 illustrates a front top view of an article of manufacture providing an herb storage and dispenser joined with a rolling paper storage and dispenser having a removable nest holding smaller rolling papers according to the present invention. In FIG. 10, a removable nest 101 is included and inserted within the rolling paper cartridge 25. The removable nest is sized to slide in the rolling paper cartridge 25 having a pair of nest rails 102*a-n* engage the pair of retaining rails 21-22 of the rolling paper cartridge 25. The removable nest 101 is a smaller version of the rolling paper cartridge 25 for storing a smaller package of rolling papers 30 than ones that fit within the rolling paper cartridge 25. The entire removable nest 101 slides out of the rolling paper cartridge 25 by pulling upward on the removable nest 101 until it has cleared the pair of retaining rails 21-22.

Figure 11:
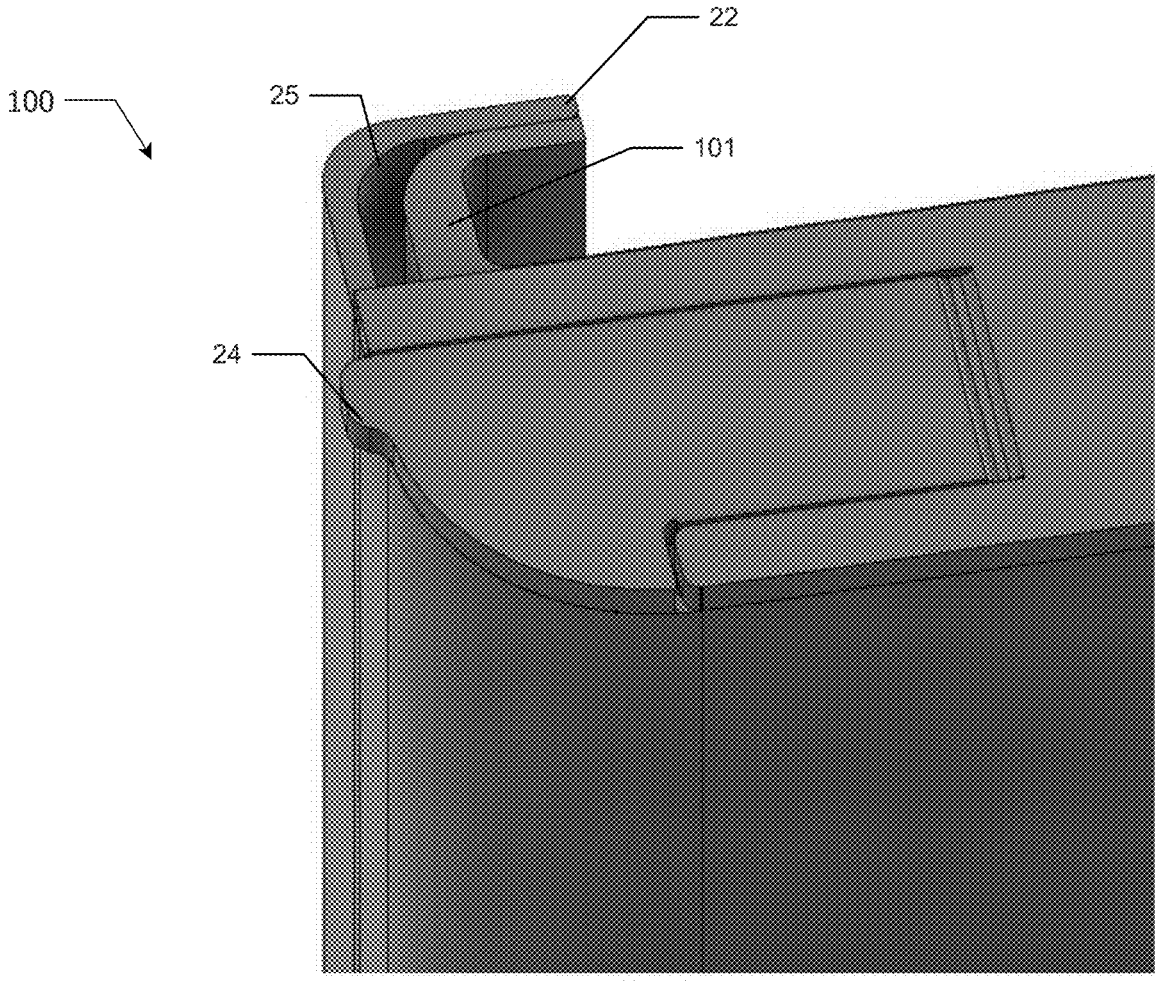
FIG. 11 illustrates a front top view of an article of manufacture providing an herb storage and dispenser joined with a removable nest according to the present invention.

FIG. 11 illustrates a front top view of an article of manufacture providing an herb storage and dispenser joined with a removable nest according to the present invention. An upper corner of the rolling paper cartridge 25 is shown about the side having the dispensing lid 24. The removable nest 101 is shown engaging one of the pair of retaining rails 22 with one of its nest rails 102*b*. The removable nest 101 may be inserted into the rolling paper cartridge 25 to hold a smaller package of rolling papers.

Figure 12D:
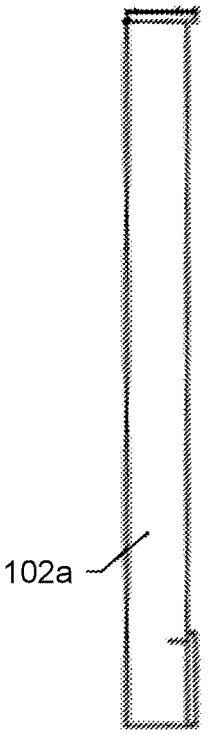
FIG. 12D illustrates a left side top view of an article of manufacture providing a removable nest for storing rolling paper storage according to the present invention.
Figure 12C:
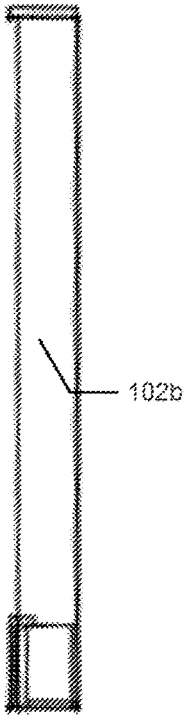
FIG. 12C illustrates a right side view of an article of manufacture providing a removable nest for storing rolling paper storage according to the present invention.
Figure 12A:
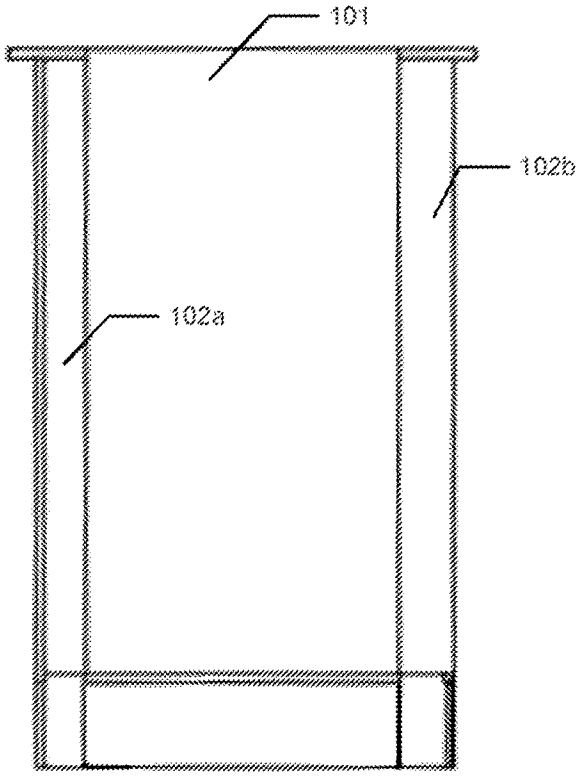
FIG. 12A illustrates a front view of an article of manufacture providing a removable nest for storing rolling paper storage according to the present invention.
Figure 12B:
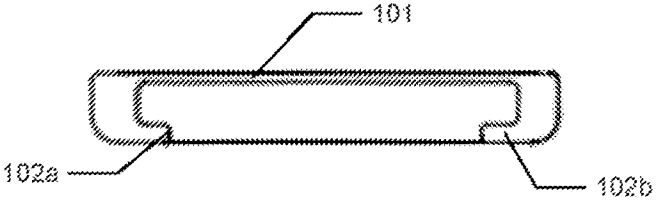
FIG. 12B illustrates a top view of an article of manufacture providing a removable nest for storing rolling paper storage according to the present invention.

FIGS. 12A-12D illustrate an article of manufacture providing a removable nest for storing rolling paper storage according to the present invention. FIG. 12A shows a front view of the removable nest. FIG. 12B shows a top view of the removable nest for storing rolling paper storage according to the present invention. FIG. 12C shows a right side view of the removable nest for storing rolling paper storage according to the present invention. FIG. 12D shows a left side top view of the removable nest for storing rolling paper storage according to the present invention.

Even though particular combinations of features are recited in the present application, these combinations are not intended to limit the disclosure of the invention. In fact, many of these features may be combined in ways not specifically recited in this application. In other words, any of the features mentioned in this application may be included to this new invention in any combination or combinations to allow the functionality required for the desired operations.

No element, act, or instruction used in the present application should be construed as critical or essential to the invention unless explicitly described as such. Further, the phrase "based on" is intended to mean "based, at least in part, on" unless explicitly stated otherwise.

What is claimed is:

1. An article of manufacture providing a storage and dispenser for herbs joined with a rolling paper storage and dispenser, the article comprising:

a container including a storage compartment for holding dry herbs and an outside surface, the storage compartment including an opening for providing access to an interior of the storage compartment;

a removable lid removably attachable to the storage compartment to cover the opening, the removable lid having a smaller dispensing lid to pivot open and provide access to the storage compartment while the removable lid remains in place over the opening;

a pair of retaining rails protruding outwardly from the outside surface of the container, the pair of retaining rails extending longitudinally along the container and aligned with the side edges of the storage compartment, the pair of retaining rails defining a first integrated rolling paper cartridge for receiving and holding a first package of rolling papers used with the dry herbs, the pair or retaining rails including a flat surface extending outwardly from the outside surface of the container, the flat surface extending laterally across a bottom side of the container and spanning the pair of retaining rails, the flat surface further including a recess to enable manipulation of a first package of rolling papers placed in the first integrated rolling paper cartridge by a user's finger to remove the first package of rolling papers from the first integrated rolling paper cartridge; and a removable nest for holding a second package of rolling papers, the removable nest slidable into the pair of retaining rails, the removable nest including a pair of nest rails removably engageable with the pair of retaining rails to hold the removeable nest in the retaining rails, the removable nest defining a second integrated rolling paper cartridge configured to receive and hold the second package of rolling papers.

2. The article of manufacture of claim 1, wherein:

the second integrated rolling paper cartridge is smaller than the first integrated rolling paper cartridge; and the second package of rolling papers is smaller than the first package of rolling papers.

3. The article of manufacture of claim 2, wherein the article is made of a material comprising one of the following: plastic, glass, aluminum, and steel.

* * * * *